United States Patent [19]

Linder

[11] 4,010,834

[45] Mar. 8, 1977

[54] PRINTING DEVICE COMPRISING A DISTANCE MEMBER

[75] Inventor: Ebbe Linder, Jarfalla, Sweden

[73] Assignee: U.S. Philips Corporation, New York, N.Y.

[22] Filed: Feb. 23, 1976

[21] Appl. No.: 660,697

[30] Foreign Application Priority Data

June 3, 1975 Sweden ..... 7502473

[52] U.S. Cl. ..... 197/1 R; 101/93.03; 197/149

[51] Int. Cl.² ..... B41J 3/05

[58] Field of Search ..... 197/1 R, 149; 101/93.03, 93.05

[56] References Cited

UNITED STATES PATENTS 3,750,792 8/1973 Liles ..... 197/1 R

FOREIGN PATENTS OR APPLICATIONS 2,318,947 10/1974 Germany ..... 197/1 R
2,248,262 4/1974 Germany ..... 197/1 R
2,162,230 6/1973 Germany ..... 197/1 R

OTHER PUBLICATIONS

B481,600, Jan. 1976, Thomas et al., 197/1 R X.

*Primary Examiner*—Clifford D. Crowder
*Attorney, Agent, or Firm*—Frank R. Trifari; David R. Treacy

[57] ABSTRACT

A printing device comprising a printing head, in which the ends of printing members facing a record carrier can be adjusted to a predetermined distance from the record carrier. The distance member comprises a curved leaf spring which is connected to a contact member which contacts the record carrier. The distance between the record carrier and the printing members (the printing distance) is adjusted by changing the curvature of the leaf spring. The printing distance can thus be maintained at an as constant as possible value also in the case of thickness variations of the record carriers or wear of the printing members.

3 Claims, 2 Drawing Figures

PRINTING DEVICE COMPRISING A DISTANCE MEMBER

The invention relates to a printing device comprising a printing head which is displaceable along a record carrier at a printing distance which is determined by a distance member which contacts the record carrier during printing, the printing head being displaceable with respect thereto in the direction to or from the record carrier for the adjustment of the printing distance between the printing head and the record carrier.

Printing devices comprising a distance member for adjusting the distance between the printing head and the record carrier (printing distance) are used if record carriers of varying thickness or record carriers of different thickness are to be printed in one and the same printing device. The distance member serves to maintain a constant printing distance.

The printing members of such a printing device may be of the impact type, but also, for example, of the electrostatic type. Printing members of the impact type are often electromagnetically driven pins. In that case the characters to be printed are composed of a matrix of points. This type of printing device is often referred to as a matrix printer. The use of a distance member is particularly important in matrix printers comprising printing members of the impact type, because such a distance member not only enables a constant printing distance to be maintained for different thicknesses of the record carrier, but also an as constant printing thickness as possible in the case of mechanical wear of the printing members. After wear, the printing distance is readjusted from time to time by means of the distance member.

The printing head is displaced in the direction of the line to be printed along a guide which extends parallel to the record carrier. This displacement may be intermittent but also continuous. The record carrier is transported in a direction transverse of the displacement direction of the printing head. The record carrier can also be displaced intermittently as well as continuously. If use is made of a distance member, which contacts the record carrier during printing, however, preference is given to intermittent transport of the record carrier.

The use of a distance member makes it necessary for the printing head to be displaceable in a direction transverse of the record carrier. This can be realized by arranging the guide along which printing head moves parallel to the record carrier to be displaceable, or alternatively by arranging the printing head to be displaceable on a separate carriage which itself moves parallel to the record carrier along the said guide. A transverse guide for the printing head is then mounted on this separate carriage.

In a known printing device of the kind set forth (West-German Patent application publ. No. 1,806,714) the printing head is detachably arranged on a carriage which is displaceable along a longitudinal guide which extends parallel to the record carrier. The printing head is displaceable with respect to the carriage along a transverse guide provided on this carriage. The printing head and the carriage can be moved as a unit to and from the record carrier (during printing) but the printing head can also be displaced — after having been unscrewed from the carriage — in the transverse direction with respect to the carriage on the transverse guide provided on the carriage. On the carriage there is rigidly mounted a sensor which ensures a constant distance between record carrier and printing head, because the printing head is rigidly connected to the carriage during printing. Should wear of the printing member (pins) have caused an undesired increase of the printing distance, the printing head is unscrewed from the carriage and is displaced, by means of an eccentric, in the transverse direction with respect to the carriage until the wear has been compensated for. Subsequently, the printing head is screwed down on the carriage again.

One of the drawbacks of the known printing device is that the distance adjustment system employed therein is not suitable for printing devices which do not comprise a separate carriage having a transverse guide for the printing head. Part (the sensor) of the distance adjustment system is mounted on the carriage, while an other part (a profile on the printing head which cooperates with the eccentric) is situated on the printing head.

It is to be noted that it is known (from West-German pat. appl. publ. No. 2,248,262) to guide the printing head along a guide which is secured to a sensor which is rotatable in a rigidly arranged frame, the distance between the sensor and the printing members being constant. In that case an additional facility must be included to compensate for any increase of the printing distance caused by wear.

The invention has for its object to provide a printing device in which the drawbacks of the known printing devices are avoided.

To this end, a printing device of the kind set forth is characterized in that the distance member comprises a leaf spring which is coupled to a contact member and which comprises an adjustable curvature in its longitudinal direction, the said leaf spring being guided along and contacting, near both ends of the curvature, the surface of the printing head, the connecting line between the two said guide points on the printing head being substantially transverse of the plane of the record carrier at the printing area.

The invention will be described in detail hereinafter with reference to the drawing.

Figure 1:
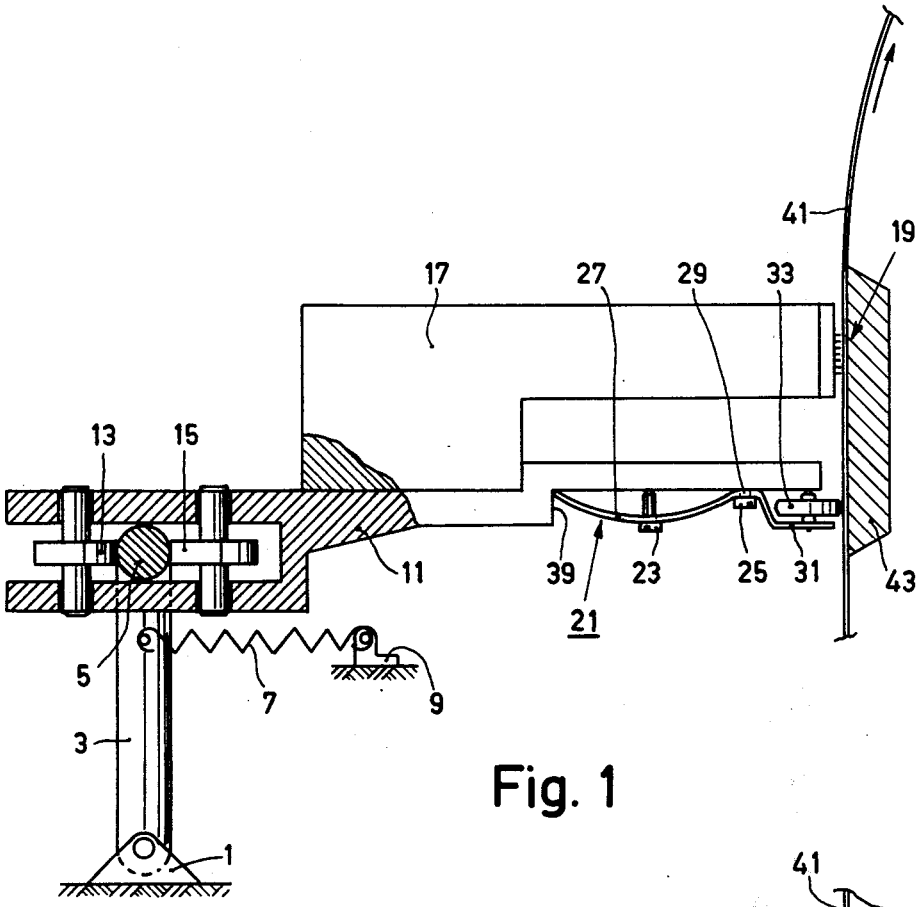
FIG. 1 is a diagrammatic (partly sectional) side elevation of a preferred embodiment of a printing device in accordance with the invention.
Figure 2:
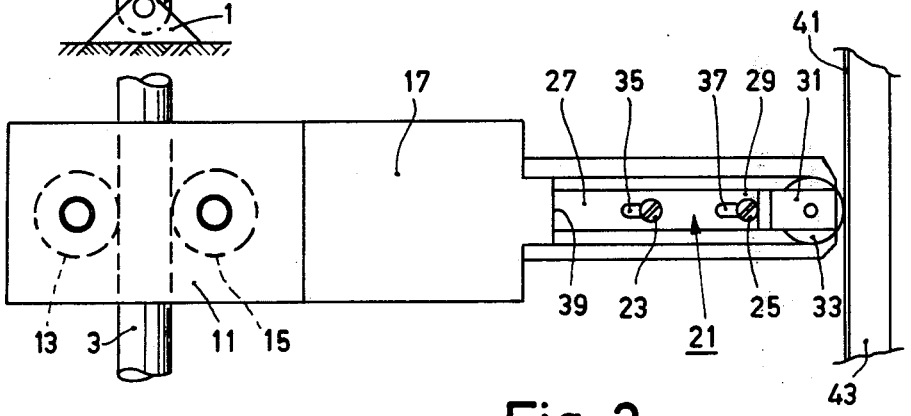
FIG. 2 is a bottom view of the printing device shown in FIG. 1.

The printing device shown in the FIGS. 1 and 2 comprises a rigidly mounted hinge 1 in which a hinge arm 3 is pivotally journalled. The hinge arm 3 has connected to it a guide bar 5 which extends in a direction perpendicular to the plane of the drawing. The hinge arm 3 is connected to a rigidly arranged supporting point 9 by way of a tension spring 7. A carriage 11 is displaceable along the guide bar 5 by way of wheels 13 and 15 which are rotatably arranged in a wedge-shaped recess of the carriage 11. A printing head 17 is mounted on the carriage 11. The printing head 17 can be detachably mounted on the carriage 11, but can alternatively form an integral part of the carriage 11. The printing head 17 comprises seven printing members 19 which are formed by electromagnetically driven pins. The printing members 19 are of a commonly used type, for example, as described in West-German pat. appl. publ. No. 1,806,714 and, consequently, they are only diagrammatically shown.

To the under side of the carriage 11 there is secured a curved leaf spring 21 by means of two bolts 23 and 25 screwed into the carriage. The leaf spring 21 comprises a curved portion 27 which is adjoined by a first flat portion 29. The first flat portion 29 is adjoined by a second flat portion 31 which has been shifted as if it were parallel to the portion 29 in the downward direction. The space thus formed between the carriage 11 and the portion 31 of the leaf spring 21 accommodates a wheel 33 which is rotatably connected to the portion 31. The wheel 33 can alternatively be suspended in a separate fork secured to the portion 29 or the extension thereof. The portion 31 can then be dispensed with. The combination formed by the leaf spring 21, the bolts 23 and 25 and the wheel 33 forms an adjustable distance member. The bolts 23 and 25 are inserted through openings 35 and 37, respectively, in the leaf spring 21. The openings 35 and 37 have an elongated shape (see FIG. 2). The free end of the portion 27 of the leaf spring bears on an edge 39 of the carriage 11.

Under the influence of the tension spring 7, the wheel 33 is slightly biased during printing against a record carrier 41 and an anvil 43 arranged behind the record carrier. The record carrier 41 is transported in the direction of the arrow (FIG. 1). In the non-energized condition, the free ends of the printing pins are situated at some distance (the printing distance) from the record carrier 41. It is very important that this printing distance is accurately adjusted and maintained as constant as possible, both in the case of thickness variations of record carriers and after wear of the printing pins. The printing distance is adjusted by first unscrewing the bolt 25 and by subsequently screwing the bolt 23 which is near the center of the curved portion slightly further into or out of the carriage 11. When the bolt 23 is screwed further in or out, the curvature of the portion 27 of the leaf spring changes. The free end of the leaf spring 21 which faces the record carrier 41 is then displaced in the direction towards or from the record carrier 41 in the direction perpendicular to the plane of the record carrier at the area of the wheel 33. After the desired printing distance has been adjusted by the adjustment of the bolt 23, the bolt 25 is tightened again. The opening 35 in the leaf spring 21 must be elongated because the leaf spring bears on the edge 39 of the carriage 11. The connecting line between the contact areas of the spring and the carriage extends transverse of the plane of the record carrier. However, it is alternatively possible to omit the edge 39, so that the free end of the portion 27 of the leaf spring can freely slide along the surface of the carriage 11. The opening 35, however, must then be round and must accurately fit around the stem of the bolt 23. In a construction of this kind, the displacement of the wheel 33 is smaller for the same rotation of the bolt 23, of course, than in the construction shown which comprises the edge 39. The opening 37 must always be elongated. Furthermore, the bolts 23 and 25 can be replaced by U-shaped brackets, the bottom of these brackets engaging the relevant portions of the leaf spring. The legs of the brackets are then inserted through a transverse bar on the upper side of the carriage 11. The curvature of the leaf spring can be adjusted by means of nuts screwed onto the threaded ends of the legs of the brackets.

In the described device, the leaf spring is adjusted after wear of the printing pins. The wheel 33 is then shifted to the right with respect to the carriage. Thickness variations of the record carrier are compensated for by the tension spring 7 after the hinging of the hinge arm 3. The hinge arm is turned counter-clockwise by a construction not shown, for example, when a new record carrier is inserted.

However, if the distance adjustment system according to the invention is used in a printing device in which the carriage cannot perform a transverse movement, while the printing head is detachably and displaceably mounted on the carriage, the printing head can be adjusted with respect to the carriage by means of the leaf spring. The distance adjustment system is then situated on the printing head. After the printing distance has been adjusted, for example, because thicker or thinner record carriers than previously have to be used for some time, the printing head is secured again with respct to the carriage.

In printing devices in which the printing head continuously moves towards and from the record carrier, under the influence of thickness variations of the record carrier, via a transverse guide on the carriage, the described distance adjustment can also be successfully applied to compensate for wear of the printing pins.

Finally, it is to be noted that instead of a wheel 33, use can also be made of a slide, even though the friction between distance member and record carrier is then increased. Furthermore, a pressure roller can be arranged between the wheel 33 and the record carrier 41 in order to spread the contact pressure.

What is claimed is:

1. In a printing device comprising a printing head which is displaceable along a record carrier at a printing distance which is determined by an adjustable distance member, the printing head being displaceable in the direction to or from the record carrier by adjustment of said distance member for adjustment of the printing distance between the printing head and the record carrier, the improvement wherein the distance member comprises a contact member which contacts the record carrier during printing, and a leaf spring which is coupled to said contact member and which comprises an adjustable curvature in its longitudinal direction, the leaf spring being guided along and contacting, near both ends of the curvature, surface areas of the printing head, the connecting line between the two surface contact areas on the printing head being substantially transverse of the plane of the record carrier at the printing area.

2. A printing device as claimed in claim 1, wherein the leaf spring comprises a flat portion which adjoins the curved portion and which is parallel to the face of the printing head which is contacted by the leaf spring, the leaf spring being secured to the printing head near the center of the curved portion and the flat portion by means of screw-bolts which project through openings in the leaf spring, at least the opening situated in the flat portion having an elongated shaped.

3. A printing device as claimed in claim 1 wherein the contact member consists of a rotatable roller which is secured to the end portion of the leaf spring which faces the record carrier.

* * * * *

UNITED STATES PATENT AND TRADEMARK OFFICE

CERTIFICATE OF CORRECTION

PATENT NO. : 4010834

DATED : March 8, 1977

INVENTOR(S) : EBBE LINDER

It is certified that error appears in the above-identified patent and that said Letters Patent are hereby corrected as shown below:

The Foreign Application Priority Data should be changed from

"June 3, 1975" to --March 6, 1975--

Signed and Sealed this

*fifth* Day of *July 1977*

[SEAL]

*Attest:*

RUTH C. MASON
*Attesting Officer*

C. MARSHALL DANN
*Commissioner of Patents and Trademarks*